US006163615A

United States Patent [19]

Callahan

[11] Patent Number: 6,163,615

[45] Date of Patent: Dec. 19, 2000

[54] CIRCUMAURAL EAR CUP AUDIO SEAL FOR USE IN CONNECTION WITH A HEADSET, EAR DEFENDER, HELMET AND THE LIKE

[75] Inventor: Thomas F. Callahan, Grantham, N.H.

[73] Assignee: University Research & Engineers & Associates, Inc., Grantham, N.H.

[21] Appl. No.: 09/129,797

[22] Filed: Aug. 6, 1998

Related U.S. Application Data

[60] Provisional application No. 60/055,395, Aug. 6, 1997.

[51] Int. Cl.[7] ..... H04R 25/00

[52] U.S. Cl. ..... 381/371; 381/372

[58] Field of Search ..... 381/371, 372, 381/189, 392; 181/129; 2/209

[56] References Cited

U.S. PATENT DOCUMENTS

| | | | |
|---|---|---|---|
| D. 391,575 | 3/1998 | Bergin et al. | D142/223 |
| 1,527,802 | 2/1925 | Huggins | 181/129 |
| 1,615,028 | 1/1927 | Morser | 381/371 |
| 2,468,721 | 4/1949 | Volkmann | 181/129 |
| 3,663,973 | 5/1972 | Spence | 5/348 |
| 3,737,930 | 6/1973 | Oscar | 5/348 WB |
| 3,908,200 | 9/1975 | Lundin | 2/209 |
| 4,170,275 | 10/1979 | Larsen | 181/129 |
| 4,260,575 | 4/1981 | Thew et al. | 264/154 |
| 4,302,635 | 11/1981 | Jacobsen et al. | 381/371 |
| 4,456,642 | 6/1984 | Burgdorfer et al. | 428/68 |
| 4,471,496 | 9/1984 | Gardner | 2/209 |
| 4,674,134 | 6/1987 | Lundin | 2/209 |
| 4,856,118 | 8/1989 | Sapiejewski | 2/209 |
| 4,944,361 | 7/1990 | Lindgren et al. | 181/129 |
| 4,958,697 | 9/1990 | Moody | 181/129 |
| 4,989,271 | 2/1991 | Sapiejewski | 2/209 |
| 5,020,163 | 6/1991 | Aileo et al. | 2/209 |
| 5,138,722 | 8/1992 | Urella et al. | 2/209 |
| 5,243,709 | 9/1993 | Sheehan et al. | 2/209 |
| 5,917,918 | 6/1999 | Callahan | 381/67 |

OTHER PUBLICATIONS

David Clark Co., Inc., Model H20–10, Jul. 29, 1997.
David Clark Co., Inc., Parts List for the H20–20 and H20–16, Jul. 29, 1997.
David Clark Co., Inc., Aviation Accessories, Jul. 29, 1997.
David Clark Co., Inc., Aviation Headsets, 1994.
David Clark Co., Inc., Headset Accessories, 1993.
David Clark Co., Inc., Hearing Protectors,Jul. 1993.

*Primary Examiner*—Curtis A. Kuntz
*Assistant Examiner*—P Dabney
*Attorney, Agent, or Firm*—Wenderoth, Lind & Ponack, L.L.P.

[57] ABSTRACT

The present invention provides an audio seal for use in an ear cup assembly. The audio seal has a generally torus-shaped body made from a compressible material. The torus-shaped body has a generally elliptical, torus configuration over approximately two-thirds to three-quarters of its perimeter and has a head and neck pad section that covers approximately one-quarter to one-third of said body's perimeter. The head and neck pad section protrudes forwardly and radially outward to form a bulging section that deviates the said elliptical, torus configuration.

14 Claims, 6 Drawing Sheets

CIRCUMAURAL EAR CUP AUDIO SEAL FOR USE IN CONNECTION WITH A HEADSET, EAR DEFENDER, HELMET AND THE LIKE

This Application claims the benefit of U.S. Provisional Application Ser. No. 60/055,395, filed Aug. 6, 1997.

BACKGROUND OF THE INVENTION

The present invention relates to ear seals for use in connection with ear cups employed in headsets, ear defenders or protectors, helmets and the like. The invention particularly relates to a circumaural seal that provides comfort, a high performance audio seal between the earcup and a user's head, and high damping.

The noise inside the crew compartments of military and some commercial ground vehicles, aircraft, and helicopters routinely exceeds normal safe exposure levels and can reach extreme noise levels of 115 dBA or more. Voice communications using typical microphones in combination with headsets and/or helmets equipped with standard earphones can be seriously compromised in such high noise environments. Investigations have revealed that noise affects the nervous system, causing, for example, weariness, lack of concentration, nervousness, and irritability. For complex operations, crew performance is often closely correlated to speech intelligibility. Thus, high noise levels can cause the crew's performance to degrade as well as cause hearing damage and jeopardize safety.

Various active noise reduction (ANR) systems are available that can decrease to some degree the level of noise reaching the user's ears. However, the successful functioning of these (ANR) systems is often highly dependent upon adequate passive protection, i.e. dependent upon the circumaural seal and semi-rigid earcup used in connection with the ANR system.

Current, state-of-the-art circumaural earcup audio seals, however, are generally not very effective in high and extreme noise environments. Often, the earcup-to-head audio seal (ear seal) for ANR headsets does not get the level of design attention it deserves based on the critical role it plays in the total performance of the headset system. The ear seal must perform two functions exceptionally well; (1) develop the best possible audio seal between the ear cup and user's head, and (2) provide a comfortable fit (especially if it is worn for long periods). While comfort is important, the wrong choice of ear seal configuration and material will significantly degrade total system performance. One well known manufacturer employs silicone gel filled ear seals that are relatively comfortable. However, these ear seals are generally either marginally better or the same as other commercial aviation style headsets for providing an adequate audio seal. Furthermore, some state-of-the-art ear cup/ear-seal configurations exacerbate low frequency noise transmissions passing through the earcup by developing a low frequency earphone resonance because there is insufficient damping provided by the circumaural seal.

The circumaural earcup/ear-seal interface with the human skull, i.e., the fit, can have a critical influence on passive attenuation performance. Commercial seals (e.g., closed cell sponge or silicone gel), while sometimes comfortable, typically perform poorly as a noise barrier. In addition, these commercial seals, particularly near the lower extremity, i.e., at the jaw-to-skull interface, often fail to provide a satisfactory noise seal. In the area between the jaw bone and the skull, behind the ear, an opening of as much as 5–10 mm diameter may form between the ear seal and the user's head. This small breech in seal integrity can lessen passive attenuation by as much as 10 dBA. The audio seal design for other commercial seals can have considerably worse seal integrity. An inferior passive ear-seal noise barrier can seriously degrade the total system performance of a headset, ear defender, helmet or the like in a high noise environment.

SUMMARY OF THE INVENTION

The present invention provides an audio seal for use in an ear cup assembly. The audio seal has a generally torus-shaped body made from a compressible material. The torus-shaped body has a generally elliptical, torus configuration over approximately two-thirds to three-quarters of its perimeter and has a head and neck pad section that covers approximately one-quarter to one-third of said body's perimeter. The head and neck pad section protrudes forwardly and radially outward to form a bulging section that deviates the said elliptical, torus configuration.

BRIEF DESCRIPTION OF THE DRAWINGS

The above and other objects and advantages of the invention will become apparent from consideration of the following detailed description when read in conjunction with the accompanying drawings, in which like reference characters refer to like parts throughout, and in which.

DETAILED DESCRIPTION OF THE INVENTION

Figure 1:
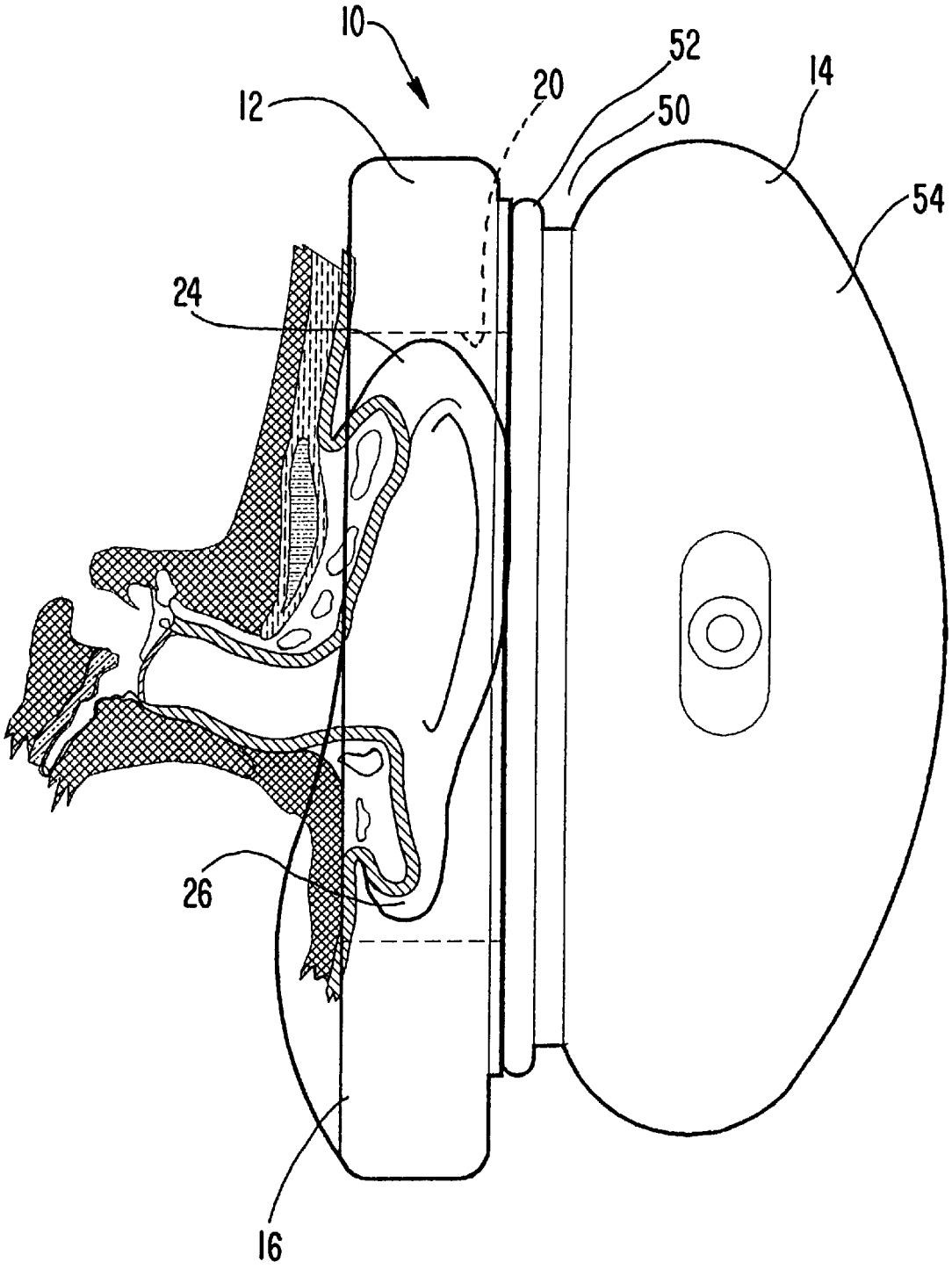
FIG. 1 is a side elevation view of an circumaural audio seal and ear cup assembly in accordance with the present invention.

FIG. 1 illustrates a circumaural audio seal and ear cup assembly 10 fitted about a user's outer ear 24 in accordance with the present invention. The audio seal and ear cup assembly 10 includes a circumaural audio seal 12 and an ear cup 14. As discussed further below, the audio seal 12 preferably comprises a relatively soft, compressible material that provides comfort to the user, high damping, and allows the seal 12 to deform and conform to the shape of the user's head surrounding the ear thereby establishing a good seal about the perimeter of the user's ear.

Figure 2:
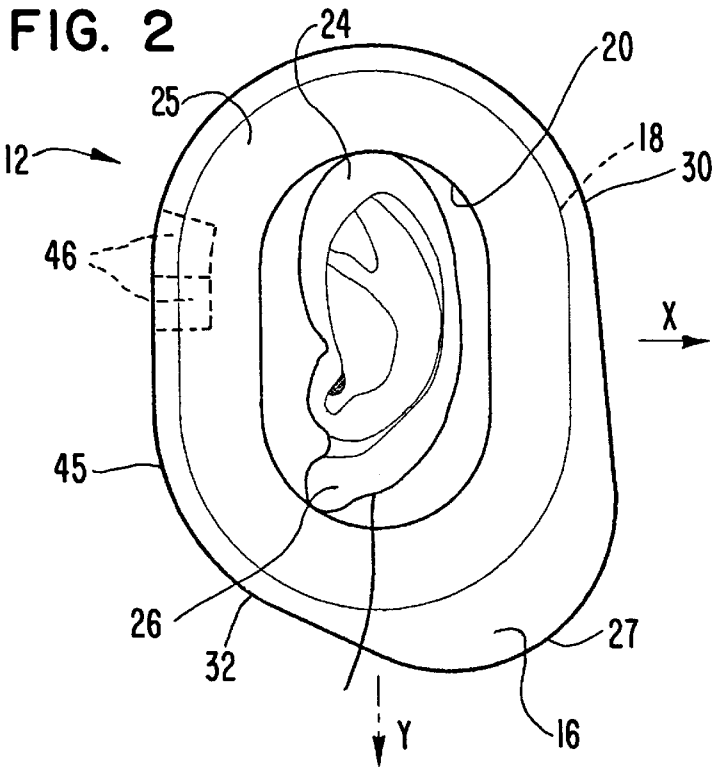
FIG. 2 is a front view of the circumaural audio seal of FIG. 1.
Figures 5, 6, 6A, 6B, 6C, 6D, 6E, 7, 7A, 7B, 7C, 7D, 7E:
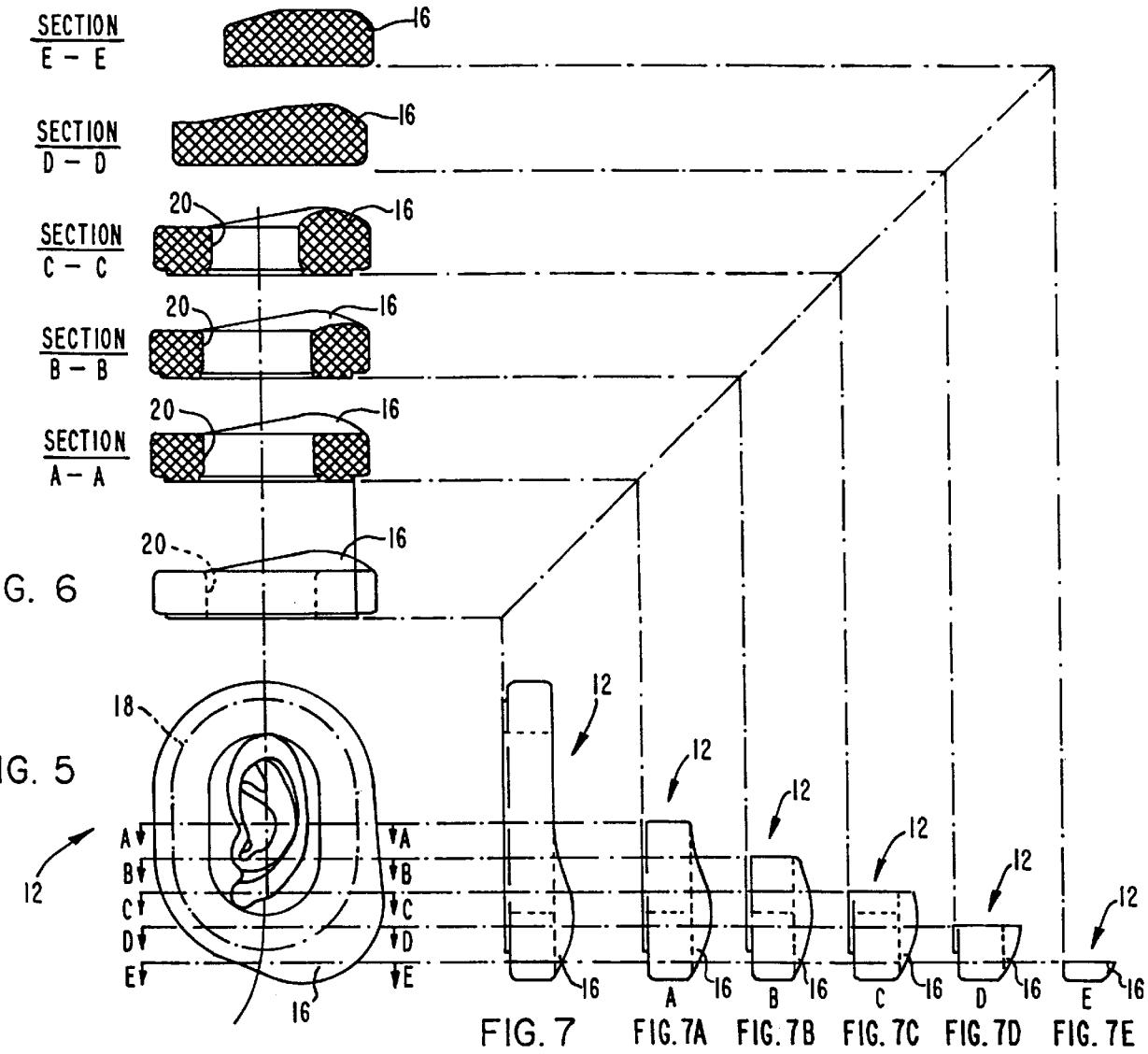
FIG. 5 is a front view of the circumaural audio seal similar to FIG. 2 with section lines.
FIG. 6 is a bottom end view similar to FIG. 3.
FIG. 6A is a cross-sectional end view taken along line A—A of FIG. 5.
FIG. 6B is a cross-sectional end view taken along line B—B of FIG. 5.
FIG. 6C is a cross-sectional end view taken along line C—C of FIG. 5.
FIG. 6D is a cross-sectional end view taken along line D—D of FIG. 5.
FIG. 6E is a cross-sectional end view taken along line E—E of FIG. 5.
FIG. 7 is a side view similar to FIG. 3.
FIG. 7A is a partial side view taken along line A—A of FIG. 5.
FIG. 7B is a partial side view taken along line B—B of FIG. 5.
FIG. 7C is a partial side view taken along line C—C of FIG. 5.
FIG. 7D is a partial side view taken along line D—D of FIG. 5.
FIG. 7E is a partial side view taken along line E—E of FIG. 5.

With reference to FIG. 2, the audio seal 12 has a generally elliptical, torus-shaped configuration with a bulging neck/head pad section 16 that conforms to the shape of user's head behind and below the ear, in the interface region between the user's jaw bone, skull and neck. Furthermore, the circumaural audio seal 12 has a flat, generally elliptical-shaped, flange 18 protruding from the back side that may be attached to the interface flange 52 of an ear cup 14 as discussed in more detail below.

The audio seal 12 follows a generally elliptical, torus configuration over approximately two-thirds to three-quarters of its perimeter. The bulging neck/head pad section 16 covers approximately one-quarter to one-third of said body's perimeter and protrudes forwardly and radially outward to form a bulging section thereby deviating from the elliptical, torus configuration.

The audio seal 12 further has a generally elliptical-shaped inner passage 20. When the audio seal 12 is in use, the user's outer ear 24 is pressed into or otherwise positioned in the passage 20. The ear seal 12 is preferably aligned so that the bulging section 16 will be behind and below the lower rim and ear lobe 26 of the user's outer ear 24 as shown in FIGS. 1 and 2.

Figure 4:
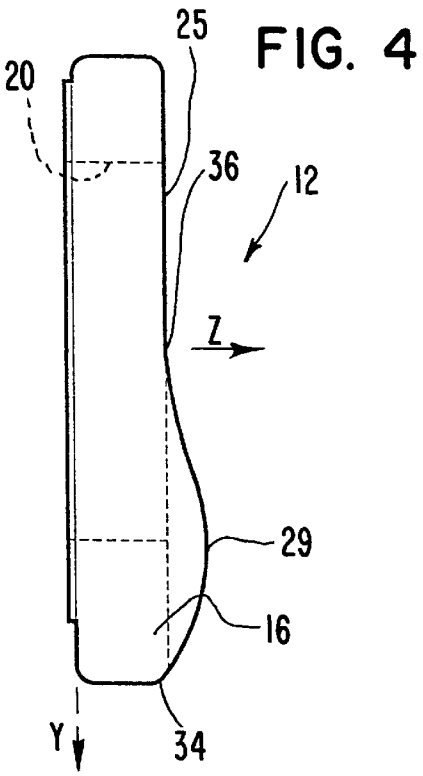
FIG. 4 is a side view of the audio seal of FIG. 2.
Figure 3:
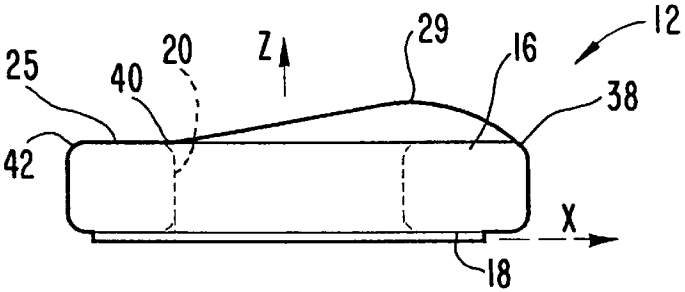
FIG. 3 is a bottom end view of the audio seal of FIG. 2.

FIGS. 2–5, 6, 7, 6A–E, and 7A–E illustrate the general contour of the bulging section 16. As shown in FIG. 2, the bulging section 16 protrudes radially outward, primarily over approximately one-quarter (¼) of the seal's perimeter, from a standard, generally elliptical configuration (for example, the outline of the flange 18, FIG. 2). In FIG. 2, the bulging section 16 is shown on the seal's lower right side, between axes X and Y. As shown in FIGS. 3 and 4, the bulging section 16 also protrudes outwardly in a forward direction (direction of Z axis) from the standard flat configuration (the flattened, non-bulging, section 25 of the seal). (It should be understood that a companion ear seal may have the bulging section 16 over its lower "left" side and that the terms "right", "left", "top", "bottom", etc. are used herein for illustrative purposes and for convenience in describing the invention. These terms are not intended to limit the scope of the invention.)

The bulging or head/neck pad section 16 has generally rounded outer limits 27 and 29, in the X-Y direction and Z direction, respectively. As shown in FIG. 2, the outer perimeter of the bulging section 16 begins a gradual radial extension at respective areas 30 and 32 along the perimeter of the seal 12. Area 30 is at the upper half of the seal 12, on the right side, aligned approximately near the top of the inner passage 20, and area 32 is at the lower half of the seal 12, on the left side.

As shown in FIG. 4, the bulging section 16 also follows a contour of increased forward extension beginning at the lower edge 34 of the seal 12 and at an area 36 approximately along the mid-point of the seal 12 and ending at the outer limit 29. As shown in FIG. 3, the bulging section 12 follows a contour of increased forward extension beginning at the right edge 38 of the seal 12 and an area 40 near the left edge 42 and ending at the outer limit 29. As shown in FIG. 3, the taper of the bulging section 16 is more gradual from area 40 on the left side than from the right edge 38.

The bulging or head/neck pad section 16 is designed to generally conform to the shape of the user's head in the region generally rearward and below the ear. When in use, the ear seal 12 is pressed against the user's head in an area surrounding the user's outer ear 24. The bulging section 16 in particular is pressed against the region of the head interfacing the user's jaw bone, skull and neck, behind the ear. Between the jaw bone and skull is a soft depressed area where the seal integrity of typical ear seals is often compromised. The bulging area 16 of the present invention ear seal 12 however is shaped to fit in and fill the depressed area thereby forming a good seal.

In a preferred embodiment of the invention, the ear seal 12 comprises a soft putty-like silicone/clay mixture that has high hysteresis loss (high damping characteristics). An example of such a material is the putty sold under the trademark SILLY PUTTY®. The putty mixture may be enclosed in a thin flexible sheath or jacket 45 for protection and to help restrain putty so that the seal 12 can maintain its shape.

In one embodiment of the invention, the sheath or jacket 45 may comprise a rubber or rubber-like material, such as neoprene, which is molded into the desired shape of the seal. The rubber material preferably has an elasticity that allows the sheath 45 to deform when pressed but which also allows the sheath 45 to recover its original shape after the pressure is released. Neoprene is a desirable for its elastic characteristics and resistance to wear and tear. The rubber sheath or jacket 45 may be covered with a thin flexible, outer cover that provides additional protection against the environment and which may absorb moisture. Examples of suitable materials for the outer cover include cloth and kid leather.

In another embodiment of the invention, the rubber jacket 45 may be formed with a plurality of internal pockets or cells 46 made from a natural rubber or synthetic rubber such as neoprene. For convenience, only two cells 46 are shown; however, from 10 to 40 cells may be formed about the entire interior of the jacket 45. The putty mixture may be injected or otherwise positioned in the individual cells or pockets 46 formed inside the rubber jacket 45. In one method of formation, the one side and the inner and outer perimeters of the seal 12 and the side walls of the individual cells 46 may be molded, the putty mixture injected into the individual cells, and then a layer of neoprene molded over the top of the cells to form the encased seal. An outer protective cover may then be positioned over the neoprene jacket.

The number, size, configuration, and location of the individual cells 46 may be modified depending upon the degree of restraint required. The cells 46 help maintain the over-all shape of the seal 12 in the presence of external pressures and gravity by preventing excessive movement of the putty within the seal. Due to the elasticity of the rubber material forming the cells 46 and jacket 45, however, the audio seal 12 will deform sufficiently to conform to the user's head and establish a good seal and barrier to noise.

An ear cup's dynamic characteristics, e.g., natural frequency and damping, are governed in large part by the audio seal. Thus, the audio seal can have a significant impact on the system's response at low frequencies. The putty-like material of the present invention audio seal 12 improves low frequency passive noise attenuation and provides exceptional comfort. In addition, the putty material tends to mold itself about the shape of the user's head (particularly in the area of the user's jaw area) and, as a result, uniformly distributes the pressure from the headset bridge (discussed further below) to provide comfort, a high performance audio seal, and high damping. Alternatively, however, the ear seal 12 may comprise a silicone gel or a closed cell foam material.

Figure 9:
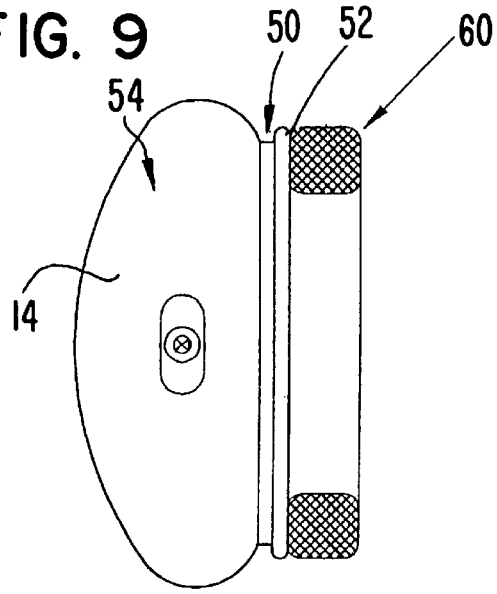
FIG. 9 is a side view of the ear cup of FIG. 8 with a conventional audio seal.
Figure 10:
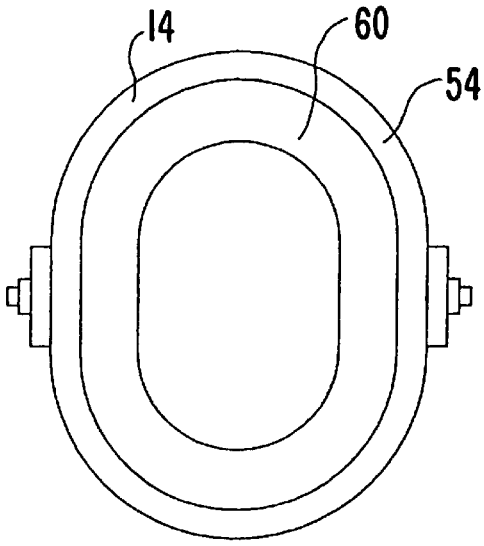
FIG. 10 is a front view of the ear cup and conventional audio seal of FIG. 9.
Figure 13:
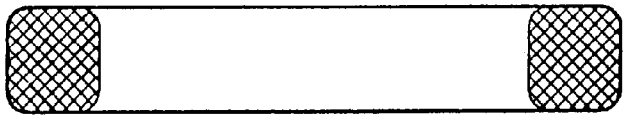
FIG. 13 is a side cross-sectional view of a conventional audio seal.
Figure 12:
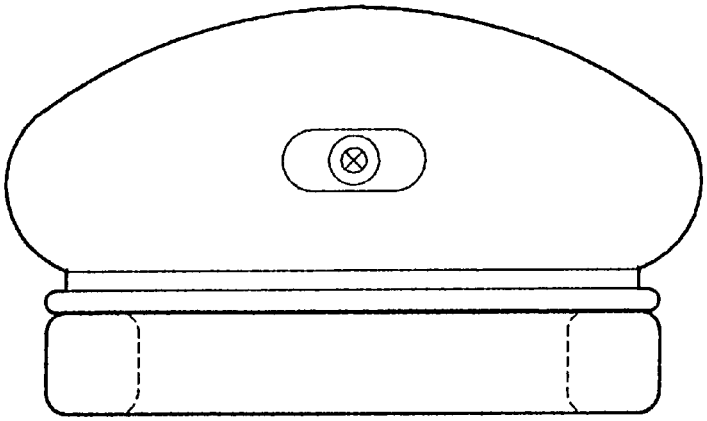
FIG. 12 is a side view of a conventional ear cup and audio seal assembly.
Figure 11:
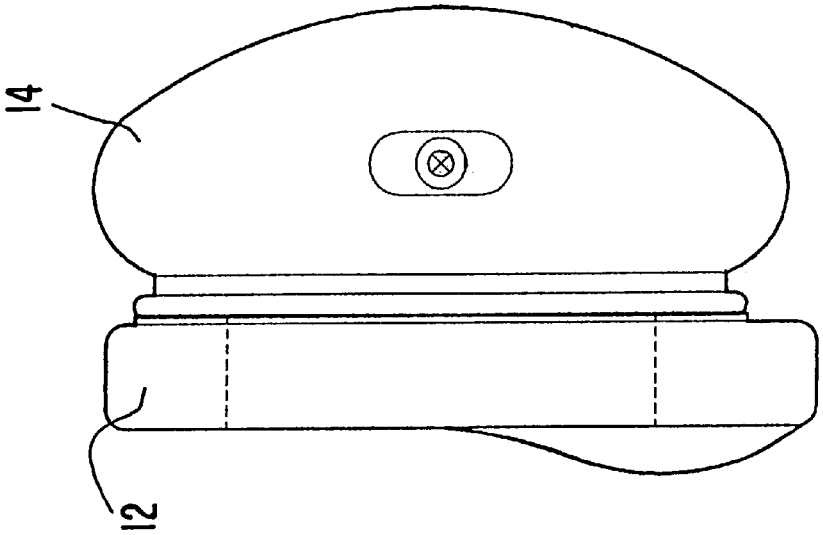
FIG. 11 is a side view of an ear cup and audio seal assembly in accordance with the present invention.

With reference to FIG. 1, the audio seal 12 of the present invention may be integrated with a conventional ear cup 14 to form an audio seal and ear cup assembly 10. A conventional ear cup 14 typically has a flat, rigid or semi rigid, torus-like interface section 50 with an ear cup flange 52 and a dome-like, outer cover section 54. The interface section 50 and the dome-like section may be integral or may be separate pieces that are mounted together to form the ear cup 14. The audio seal 12 is attached to the flange 52 of the interface section 50 with an adhesive or by other known means. FIGS. 9 and 10 show a conventional audio seal 60 mounted to the ear cup 14.

Figure 8:
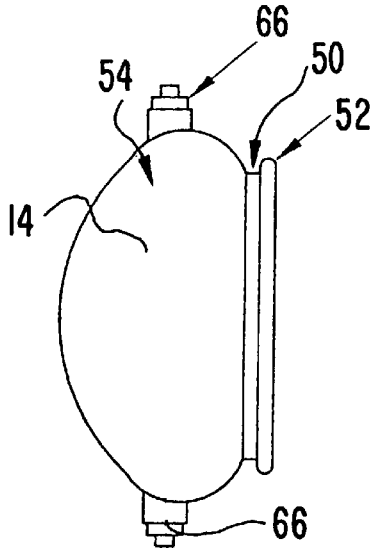
FIG. 8 is a top view of an ear cup.
Figure 14:
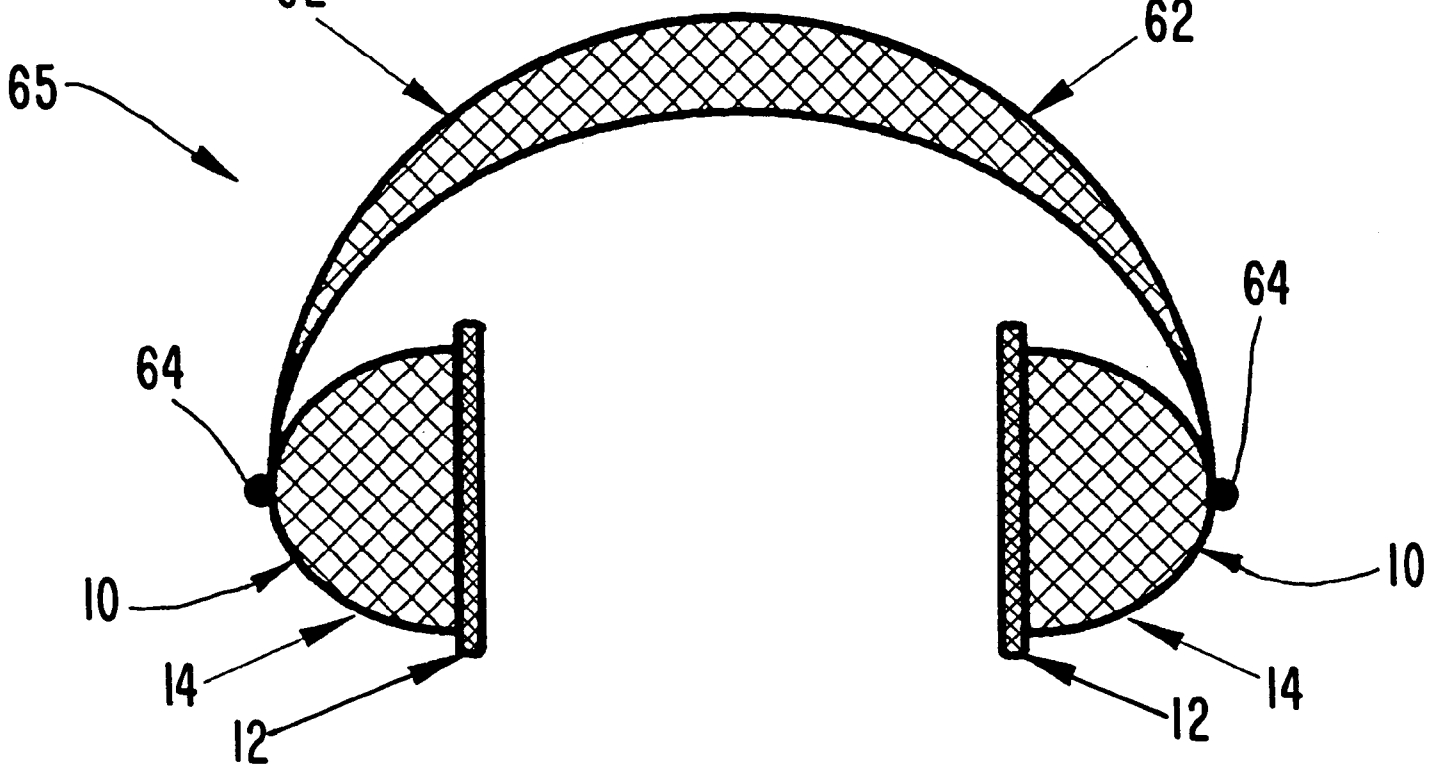
FIG. 14 is a schematic of a head set employing the ear cup and audio seal assembly of the present invention.

As shown schematically in FIG. 14, a pair of audio seal and ear cup assemblies 10 may be coupled together by an ear cup bridge or spring 62 in a conventional manner to form a head set or ear defender 65. In FIG. 14, the ear cup bridge 62 is mounted to the backs of the ear cups 14 through pivots 64. As shown in FIG. 8, however, the ear cups 14 may be provided with trunnion and trunnion boss assemblies 66 on either side which may be coupled to the ear cup bridge 62. Other known methods of attaching the ear cup 14 to a bridging assembly may also be employed. The ear cup bridge 62 applies an inward pressure to the interface sections 50 so that when the headset 65 is in use the audio seals 12 are pressed against the user's head.

The ear seal and ear cup assembly 10 of the present invention may be used in connection with a headset having integrated electronics for field applications or a passive hearing or ear defender (protector) as shown in FIG. 14 or may be used in connection with a helmet. The audio seal and ear cup assembly 10 may be integrated with the helmet in a known manner, for example, by mounting the ear cup assembly 10 to the inside wall of the helmet. The ear seal and ear cup assembly 10 may also be used with other audio receiving devices.

What is claimed is:

1. An audio seal for use in an ear cup assembly, comprising:

a generally torus-shaped body comprising a compressible material, said torus-shaped body having a generally elongated, torus configuration over approximately two-thirds to three-quarters of the perimeter of said body and has a head and neck pad section that covers approximately one-quarter to one-third of the perimeter of said body;

wherein said head and neck pad section protrudes outward to form a bulging section that deviates from said generally elongated, torus configuration; and wherein said compressible material comprises a soft, putty-like material with high damping characteristics.

2. The audio seal of claim 1, wherein said putty-like material comprises a silicone and clay mixture.

3. The audio seal of claim 1, wherein said torus-shaped body comprises a plurality of individual cells.

4. The audio seal of claim 3, wherein each said cell comprises a wall that surrounds a chamber, and said chambers are filled with said putty-like material.

5. The audio seal of claim 3, wherein said torus-shaped body comprises approximately 10 to 40 said cells.

6. An audio seal for use in sealing an area surrounding a user's ear, comprising:

a generally elongated torus-shaped body having an elongated through passage and a contact surface, said torus-shaped body further having a variable thickness such that said contact surface has a varying profile;

wherein said torus-shaped body comprises a soft compressible material with high damping characteristics whereby said compressible material exhibits high hysteresis losses and provides passive noise attenuation; and wherein said compressible material comprises a putty-like material;

whereby said through passage receives a user's ear and said contact surface is pressed against the user's head in an area that encircles the user's ear when the audio seal is in use.

7. The audio seal of claim 6 wherein said putty-like material comprises a silicone and clay mixture.

8. An audio seal for use in sealing an area surrounding a user's ear, comprising:

a generally elongated torus-shaped body having an elongated through passage and a contact surface, said torus-shaped body further having a variable thickness such that said contact surface has a varying profile;

wherein said torus-shaped body comprises a soft compressible material with high damping characteristics whereby said compressible material exhibits high hysteresis losses and provides passive noise attenuation;

wherein said torus-shaped body comprises a plurality of individual cells; and wherein each said cell comprises a wall that surrounds a chamber, and said chambers are filled with a putty-like material;

whereby said through passage receives a user's ear and said contact surface is pressed against the user's head in an area that encircles the user's ear when the audio seal is in use.

9. The audio seal of claim 8, wherein said torus-shaped body comprises approximately 10 to 40 said cells.

10. An audio seal and ear cup assembly comprising:

a generally elongated torus-shaped cushion having an elongated through passage, a contact surface, and an ear cup interface surface, said cushion further having a variable thickness such that said contact surface has a varying profile; and an ear cup mounted to said ear cup interface surface of said torus-shaped cushion;

wherein said cushion comprises a soft material with high damping characteristics whereby said cushion provides passive noise attenuation; and wherein said soft material comprises a putty-like material.

11. The audio seal and ear cup assembly of claim 10, wherein said putty-like material comprises a silicone and clay mixture.

12. The audio seal and ear cup assembly of claim 10, wherein said interface surface of said audio seal is generally flat.

13. An audio seal and ear cup assembly comprising:

a generally elongated torus-shaped cushion having an elongated through passage, a contact surface, and an ear cup interface surface, said cushion further having a variable thickness such that said contact surface has a varying profile; and an ear cup mounted to said ear cup interface surface of said torus-shaped cushion;

wherein said cushion comprises a soft material with high damping characteristics whereby said cushion provides passive noise attenuation;

wherein said cushion comprises a plurality of individual cells; and wherein each said cell comprises a wall that surrounds a chamber, and said chambers are filled with a putty-like material.

14. The audio seal of claim 13, wherein said cushion comprises approximately 10 to 40 said cells.

* * * * *